US009670019B2

(12) United States Patent
Murata

(10) Patent No.: US 9,670,019 B2
(45) Date of Patent: Jun. 6, 2017

(54) PAPER FEED DEVICE, AND DOCUMENT TRANSPORT DEVICE AND IMAGE FORMING APPARATUS INCLUDING THE SAME

(71) Applicant: KYOCERA Document Solutions Inc., Osaka-shi, Osaka (JP)

(72) Inventor: Takuro Murata, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 14/738,964

(22) Filed: Jun. 15, 2015

(65) Prior Publication Data

US 2015/0368056 A1 Dec. 24, 2015

(30) Foreign Application Priority Data

Jun. 20, 2014 (JP) ..... 2014-127097

(51) Int. Cl.
*B65H 7/06* (2006.01)
*B65H 1/14* (2006.01)
(Continued)

(52) U.S. Cl.
CPC ..... *B65H 7/06* (2013.01); *B65H 1/04* (2013.01); *B65H 1/14* (2013.01); *B65H 3/0684* (2013.01); *B65H 3/5261* (2013.01); *B65H 7/04* (2013.01); *B65H 7/18* (2013.01); *G03G 15/55* (2013.01); *G03G 15/6511* (2013.01);
(Continued)

(58) Field of Classification Search
CPC ... B65H 7/04; B65H 7/20; B65H 7/06; B65H 2513/511; B65H 2557/65; B65H 2601/10
See application file for complete search history.

(56) References Cited

U.S. PATENT DOCUMENTS 5,395,106 A 3/1995 Tohnai et al.
7,581,728 B2 * 9/2009 Yamashita ..... B65H 1/14 271/126
7,798,484 B2 * 9/2010 Takito ..... B65H 3/0661 271/10.03
9,181,055 B2 * 11/2015 Kosaka ..... B65H 7/04
2008/0292334 A1 * 11/2008 Takahashi ..... B41J 11/0095 399/38
(Continued)

FOREIGN PATENT DOCUMENTS

JP H06156815 A 6/1994
JP H11-334935 A 12/1999
(Continued)

OTHER PUBLICATIONS

Office Action issued in the corresponding Japanese patent application No. 2014-127097 dated Apr. 26, 2016, 6 pages.

*Primary Examiner* — Patrick Cicchino

(57) ABSTRACT

A paper feed device includes a paper tray, a set-state sensor, a paper feed unit, and a control unit. The control unit checks an output from the set-state sensor each time before the start of the intermittent paper feed. In the case where no paper feed is detected even after the prescribed number of times of the intermittent paper feed, the control unit determines that a non-feed jam has occurred. In the case where it is detected that there is no paper on the paper tray before the number of repetition of the intermittent paper feed reaches the prescribed number of times, the control unit causes the paper feed unit to terminate the retry processing and determines that, with no paper on the paper tray, it is not the non-feed jam.

8 Claims, 8 Drawing Sheets

(51) Int. Cl.

| | |
|---|---|
| ***B65H 3/52*** | (2006.01) |
| ***B65H 7/04*** | (2006.01) |
| ***G03G 15/00*** | (2006.01) |
| ***B65H 1/04*** | (2006.01) |
| ***B65H 3/06*** | (2006.01) |
| ***B65H 7/18*** | (2006.01) |

(52) U.S. Cl.
CPC ..... *G03G 15/70* (2013.01); *B65H 2511/11* (2013.01); *B65H 2511/414* (2013.01); *B65H 2511/51* (2013.01); *B65H 2513/53* (2013.01); *B65H 2553/82* (2013.01); *B65H 2701/1313* (2013.01); *B65H 2801/06* (2013.01); *B65H 2801/39* (2013.01); *G03G 15/6564* (2013.01); *G03G 2215/00721* (2013.01); *G03G 2215/00725* (2013.01)

(56) References Cited

U.S. PATENT DOCUMENTS

| | | | | |
|---|---|---|---|---|
| 2013/0168923 | A1* | 7/2013 | Sugimoto ..... | B65H 7/06 271/258.01 |
| 2015/0014914 | A1* | 1/2015 | Sung ..... | H04N 1/00652 271/110 |
| 2015/0115522 | A1* | 4/2015 | Kosaka ..... | B65H 7/04 271/153 |

FOREIGN PATENT DOCUMENTS

| | | | |
|---|---|---|---|
| JP | 2003327337 | A | 11/2003 |
| JP | 2005247482 | A | 9/2005 |

* cited by examiner

PAPER FEED DEVICE, AND DOCUMENT TRANSPORT DEVICE AND IMAGE FORMING APPARATUS INCLUDING THE SAME

INCORPORATION BY REFERENCE

The disclosure of Japanese Patent Application No. 2014-127097 filed on Jun. 20, 2014 including the specification, drawings and abstract is incorporated herein by reference in its entirety.

BACKGROUND

The present disclosure relates to paper feed devices, document transport devices, and image forming apparatuses which detect with a sensor whether a sheet of paper has been set, and perform retry processing of repeating, a prescribed number of times, intermittent paper feed in which a paper feed operation is performed again when paper feed has failed.

In an image forming apparatus such as a multifunctional peripheral, a copier, a printer, or a facsimile machine, a document or other sheet of paper is set (placed) on a prescribed position, and a feeding rotary body is rotated to feed the paper. When the rotary body is worn or paper is slippery, the paper may not be fed appropriately even if the feeding rotary body is rotated. Thus, some image forming apparatuses have the function of performing retry processing in which the feeding rotary body is once stopped and then rotated again.

For example, as a typical sheet feeder, the following sheet feeder is known. A sheet loaded and fed is detected on the way of the sheet transport path. When a predetermined time has elapsed from the start of feeding a sheet without the sheet being detected, the paper feed is retried. The number of times of such retries can be arbitrarily set, and the paper feed can be retried up to the set number of times. With this configuration, the number of times of paper feed retries is set arbitrarily in accordance with the friction factor of the sheet fed or the wear state of the feeding roller, and the occurrence of paper jam is determined after the paper feed is retried the set number of times, in an attempt to suppress unnecessary jam processing.

SUMMARY

A paper feed device according to an aspect of the present disclosure includes a paper tray, a set-state sensor, a paper feed unit, a transport unit, a paper feed sensor, and a control unit. One or more sheets of paper are set on the paper tray. The set-state sensor includes an actuator which is configured to move when paper is set. The set-state sensor is arranged at a position where any set paper can be detected, and outputs different values depending on the position of the actuator. The paper feed unit feeds the paper set on the paper tray by rotating a feeding rotary body. The transport unit transports the paper fed from the paper feed unit. The paper feed sensor is configured to detect that the paper has been sent out of the paper tray by the paper feed operation of the paper feed unit. The control unit detects the presence or absence of paper on the paper tray on the basis of the magnitude of an output value from the set-state sensor. The control unit detects whether the paper has been fed by the paper feed operation, on the basis of an output from the paper feed sensor. The control unit checks the output value from the set-state sensor when the paper feed sensor has detected passing of a tail end of the paper. When determining that there is paper, the control unit causes the paper feed unit to perform the paper feed operation for the next page. When the control unit detects on the basis of the output from the paper feed sensor that no paper has been fed, the control unit causes the paper feed unit to perform retry processing of repeating intermittent paper feed of stopping and then resuming the paper feed operation a prescribed number of times until the paper feed sensor detects paper. The control unit checks an output from the set-state sensor each time before the start of the intermittent paper feed. In the case where no paper feed is detected even after the intermittent paper feed was performed the prescribed number of times, the control unit determines that a non-feed jam has occurred. In the case where it is detected that there is no paper on the paper tray before the number of repetition of the intermittent paper feed reaches the prescribed number of times, the control unit causes the paper feed unit to terminate the retry processing and determines that, with no paper on the paper tray, it is not the non-feed jam.

DETAILED DESCRIPTION

An image forming apparatus including a paper feed device 100 according to an embodiment will be described below with reference to FIGS. 1 to 10. As an example of the image forming apparatus, a multifunctional peripheral 101 will be described. The configurations, arrangements, and other elements described in the following embodiment are merely illustrative; they are not intended to limit the scope of the disclosure.

<Outline of Multifunctional Peripheral 101>

Figure 1:
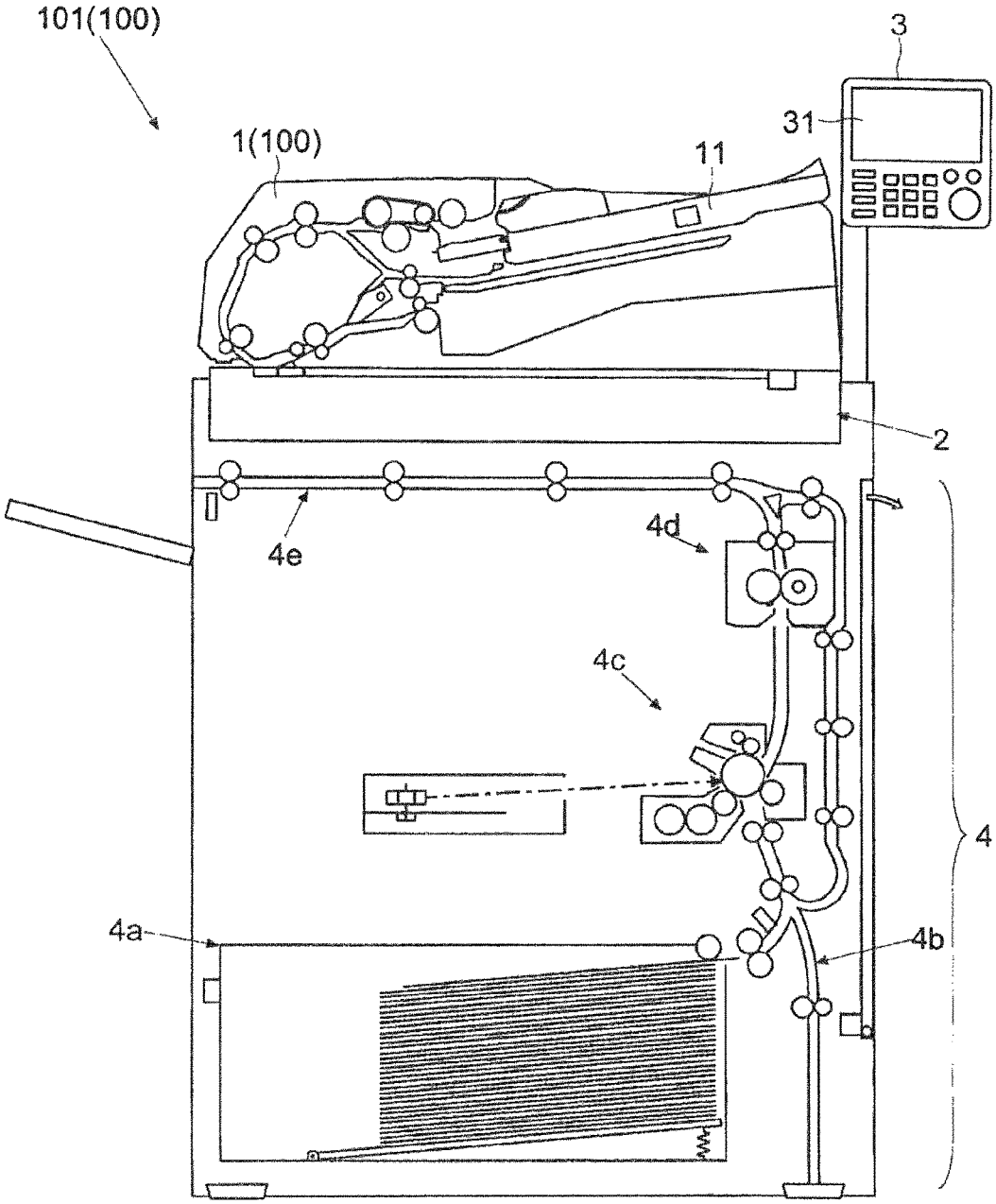
FIG. 1 shows the structure of a multifunctional peripheral.

First, the multifunctional peripheral 101 according to an embodiment will be outlined with reference to FIG. 1. FIG. 1 shows the structure of the multifunctional peripheral 101.

As shown in FIG. 1, the multifunctional peripheral 101 has, in its upper portion, a document transport device 1 and an image reading device 2. It is noted that the document transport device 1 corresponds to the paper feed device 100 according to the present disclosure. The document transport device 1 will be described in detail later. The multifunctional peripheral 101 has an operation panel 3 attached to its upper right side. The operation panel 3 accepts various operations. The operation panel 3 accepts settings for the reading of a document D (corresponding to "paper") in a job involving the document reading (copying or transmitting job based on image data of the read document D).

For example, the operation panel 3 accepts an input of determining the size of the document(s) D set in the document transport device 1 (on a document tray 11). Further, the operation panel 3 accepts settings (for a mixed-size document mode) for executing a job with documents D of different sizes loaded together on the document tray 11. The operation panel 3 also accepts various other settings such as the number of sheets of documents D loaded, resolution for reading, selection of color or monochrome reading, etc. The operation panel 3 includes a display unit 31 for displaying a setting screen and messages to a user.

Further, the multifunctional peripheral 101 has a printing unit 4 inside. The printing unit 4 includes a paper storing unit 4*a*, a first transport unit 4*b*, an image forming unit 4*c*, a fixing unit 4*d*, and a second transport unit 4*e*. The paper storing unit 4*a* stores a plurality of sheets of paper, and sends out a sheet for printing. The first transport unit 4*b* transports the sheet supplied from the paper storing unit 4*a* to the image forming unit 4*c*. The image forming unit 4*c* forms a toner image on the basis of image data for printing, and transfers the toner image onto the sheet. The fixing unit 4*d* applies heat and pressure to the sheet with the toner image transferred thereon, for fixing the toner image on the sheet. The second transport unit 4*e* discharges the sheet that has passed through the fixing unit 4*d*, to the outside of the machine.

<Hardware Configuration of Multifunctional Peripheral 101>

The hardware configuration of the multifunctional peripheral 101 according to the embodiment will now be described with reference to FIG. 2.

Figure 2:
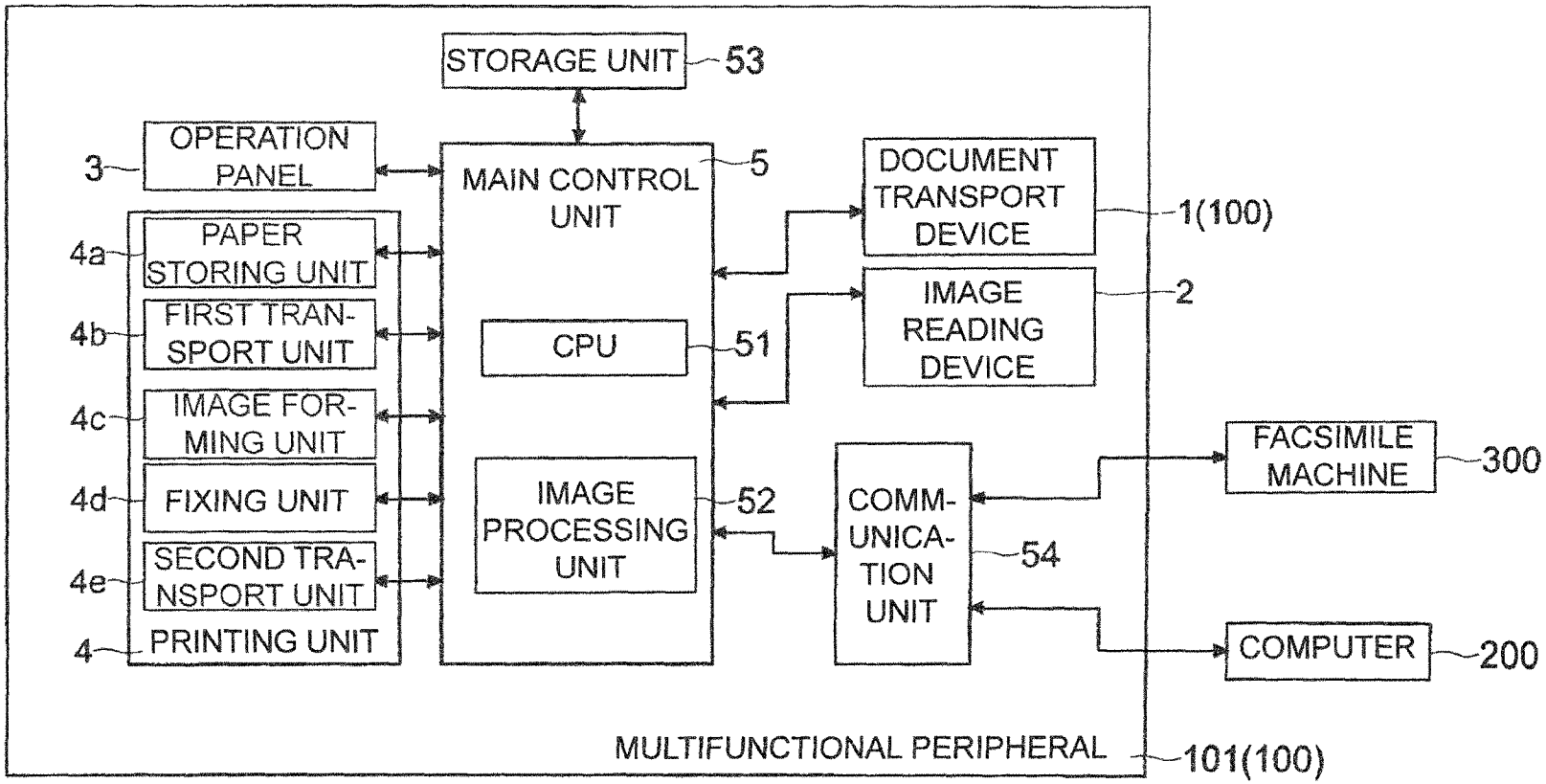
FIG. 2 shows the hardware configuration of the multifunctional peripheral.

As shown in FIG. 2, the multifunctional peripheral 101 according to the present embodiment includes a main control unit 5. The main control unit 5 controls the units and components included in the multifunctional peripheral 101. The main control unit 5 includes a CPU 51, an image processing unit 52 which performs image processing on the image data for use in printing or transmitting, and other electronic circuits and elements. The CPU 51 performs arithmetic processing and control of the units and components in the multifunctional peripheral 101, on the basis of a control program or controlling data stored in a storage unit 53. The storage unit 53 is a combination of a non-volatile storage device such as a ROM, a flash ROM, or a HDD, and a volatile storage device such as a RAM.

The main control unit 5 gives operation instructions to the printing unit 4 (paper storing unit 4*a*, first transport unit 4*b*, image forming unit 4*c*, fixing unit 4*d*, and second transport unit 4*e*), the document transport device 1, and the image reading device 2. The main control unit 5 causes the printing unit 4 to perform printing (copying function, printing function), on the basis of print data received from a computer 200, or on the basis of the image data that the image reading device 2 has obtained by reading a document D.

The main control unit 5 is connected with a communication unit 54. The main control unit 5 controls operations and communication processing of the communication unit 54. The communication unit 54 is an interface for communicating with the computer 200 such as a personal computer or a server, and with a facsimile machine 300. The main control unit 5 causes the communication unit 54 to transmit image data which is based on data obtained by reading a document D (transmitting function). The main control unit 5 also controls display and other operations of the operation panel 3. The main control unit 5 recognizes the operations and settings input to the operation panel 3, and recognizes the content of the settings, print execution instruction, and the like.

<Document Transport Device 1 and Image Reading Device 2>

Figure 3:
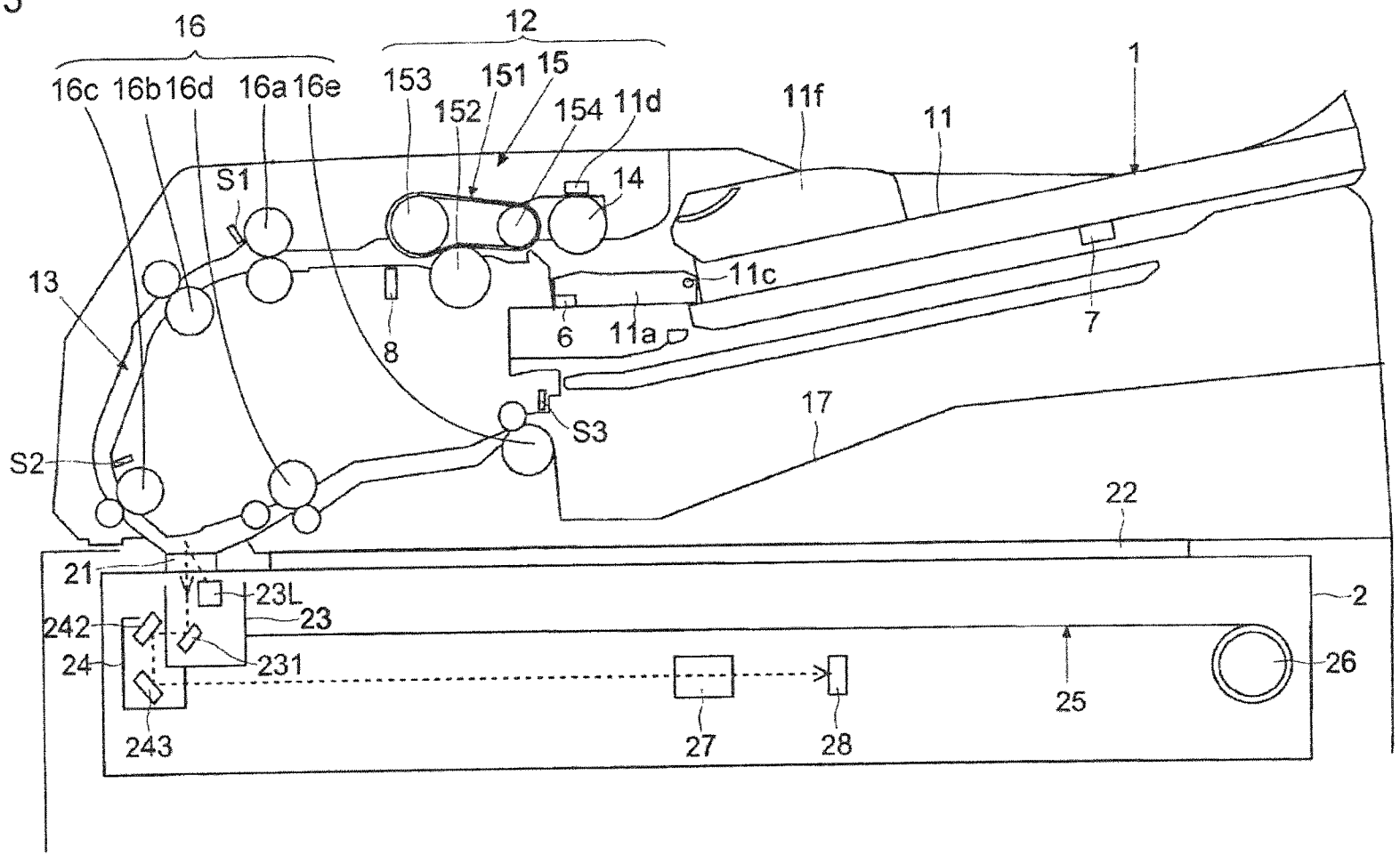
FIG. 3 is an enlarged view of parts of a document transport device and an image reading device.

The document transport device 1 and the image reading device 2 according to the embodiment will now be described with reference to FIG. 3. FIG. 3 is an enlarged view of parts of the document transport device 1 and the image reading device 2.

The document transport device 1 is disposed on top of the image reading device 2. The document transport device 1 transports a document D which has been set (see FIG. 7), toward a reading position (toward a transported-document reading contact glass 21 of the image reading device 2). The document transport device 1 is attached to the image reading device 2 on the deep side of the paper plane of FIG. 1 or 3, so that it is pivotally moved upward or downward to uncover or cover the upper surface of the image reading device 2. That is, the document transport device 1 also serves as a cover that covers, from above, glasses (the transported-document reading contact glass 21 and a placed-document reading contact glass 22) of the image reading device 2.

As shown in FIG. 3, the document transport device 1 includes, in order from the upstream side, a document tray 11 (corresponding to the "paper tray"), a paper feed unit 12 (including a pickup roller 14 and a separation transport unit 15), a transport unit 16 (including a registration roller pair 16*a*, a plurality of transport roller pairs 16*b*, 16*c*, 16*d*, and a discharge roller pair 16*e*), and a document discharge tray 17. One or more sheets of documents D are placed on the document tray 11.

Document D to be read is set on the document tray 11. The document tray 11 has an elevating portion 11*a* on its downstream side. The elevating portion 11*a*, which moves up and down, constitutes a part of the document tray 11. When sheets of documents D are set, the elevating portion 11*a* is moved upward to cause the uppermost sheet of the set documents D to abut against the pickup roller 14. When the absence of document D is detected, the elevating portion 11*a* is moved down to a lower-limit position (basic position). An elevating motor 11*b* for moving the elevating portion 11*a* up and down is provided inside the document transport device 1 (see FIG. 4). To move the elevating portion 11*a* up and down, the elevating motor 11*b* causes the elevating portion 11*a* to pivot about its pivotal shaft 11*c*, provided on the upstream side in the transport direction, so that the portion on the downstream side in the transport direction of the elevating portion 11*a* is lifted or lowered.

The pickup roller 14 of the paper feed unit 12 picks up a document D placed on the document tray 11 and supplies the document D to a document transport path 13. The pickup roller 14 rotates as it is driven by a paper feed motor 120 (corresponding to the "motor"; see FIG. 4). It is noted that a paper feed clutch 121 can be provided (see FIG. 4), which is engaged or disengaged to transmit the drive to the pickup roller 14 or interrupt the transmission thereof, for controlling rotation and stopping of the pickup roller 14.

The separation transport unit 15 of the paper feed unit 12 includes a paper feed belt 151 and a separation roller 152 arranged to face the paper feed belt 151. The paper feed belt 151 is suspended on a driving roller 153 and a driven roller 154. The paper feed belt 151 transports the document D, fed from the pickup roller 14, to the downstream side in the transport direction. The driving roller 153 rotates as it is driven by the paper feed motor 120 (or another motor for rotating the driving roller 153 may be provided). The rotation of the driving roller 153 causes the paper feed belt 151 to circulate. The separation roller 152 rotates as it is driven by a separation motor 155 (see FIG. 4). When two or more sheets of documents D are fed in an overlapped state (upon occurrence of multiple feed), the separation roller 152 separates the underlying sheet(s) of document(s) D out of the overlapped sheets of documents D, and feeds the separated sheet(s) back toward the document tray 11.

The registration roller pair 16*a*, the transport roller pairs 16*b*, 16*c*, 16*d*, and the discharge roller pair 16*e* constituting the transport unit 16 transport each document D along the document transport path 13, and finally discharge the document D onto the document discharge tray 17.

At the time point when the leading edge of a document D reaches the registration roller pair 16*a*, the registration roller pair 16*a* has been stopped so as to cause the document D that has abutted against the nip of the registration roller pair 16*a* to warp or bend for correction of a skew of the document D. At the timing when the document D has bent by a certain amount while being transported by the separation transport unit 15, the registration roller pair 16*a* starts rotating to feed the document D downstream. The registration roller pair 16*a* is driven by a transport motor 160 (see FIG. 4). It is noted that a registration clutch 161 is provided (see FIG. 4), which is engaged or disengaged to transmit the drive to the registration roller pair 16*a* or interrupt the transmission thereof, for controlling rotation and stopping of the registration roller pair 16*a*.

The transport roller pairs 16*b*, 16*c*, and 16*d* each transport a document D (from the upstream side to the downstream side) along the transport direction of the document D. The discharge roller pair 16*e* discharges the document D that has been read, onto the document discharge tray 17. The transport roller pairs 16*b*, 16*c*, 16*d*, and the discharge roller pair 16*e* are driven by the transport motor 160.

The transported-document reading contact glass 21 of the image reading device 2 is located on the way of the document transport path 13. The image reading device 2 reads the document D that passes over the transported-document reading contact glass 21 (the position above the transported-document reading contact glass 21 corresponds to the reading position).

The image reading device 2 will now be described. As shown in FIGS. 1 and 3, the image reading device 2 has a box-shaped casing. As also shown in FIG. 3, the image reading device 2 includes, inside the casing, a first moving frame 23, a second moving frame 24, wire 25, a winding drum 26, a lens 27, and an image sensor 28 which receives light reflected from a document D to read the document D, line by line, and generate image data.

The first moving frame 23 includes a light source 23L (for example, an LED or a cold-cathode tube) which irradiates a document D with light, and a first mirror 231. The second moving frame 24 includes a second mirror 242 and a third mirror 243. A plurality of pieces of wire 25 are attached to the first moving frame 23 and the second moving frame 24 (only one piece of wire is shown in FIG. 3 for convenience sake). The other end of each wire 25 is connected to the winding drum 26. The winding drum 26 rotates in both directions as it is driven by a winding motor (not shown), thereby moving the moving frames freely in the horizontal direction (right-and-left direction of the image reading device 2).

In the case of reading a document D being transported by the document transport device 1, the first moving frame 23 and the second moving frame 24 are moved to the position (reading position) beneath the transported-document reading contact glass 21. In the case of reading a document D placed on the placed-document reading contact glass 22, the first moving frame 23 and the second moving frame 24 are moved from their home positions horizontally in the right direction in FIG. 3 by the winding drum 26 and the wire 25. Each mirror guides the light reflected from the document D to the lens 27. The lens 27 collects the reflected light and guides the light such that it enters the image sensor 28. The image reading device 2 generates image data of the document D on the basis of the output from the image sensor 28.

<Hardware Configuration of Document Transport Device 1>

Figure 4:
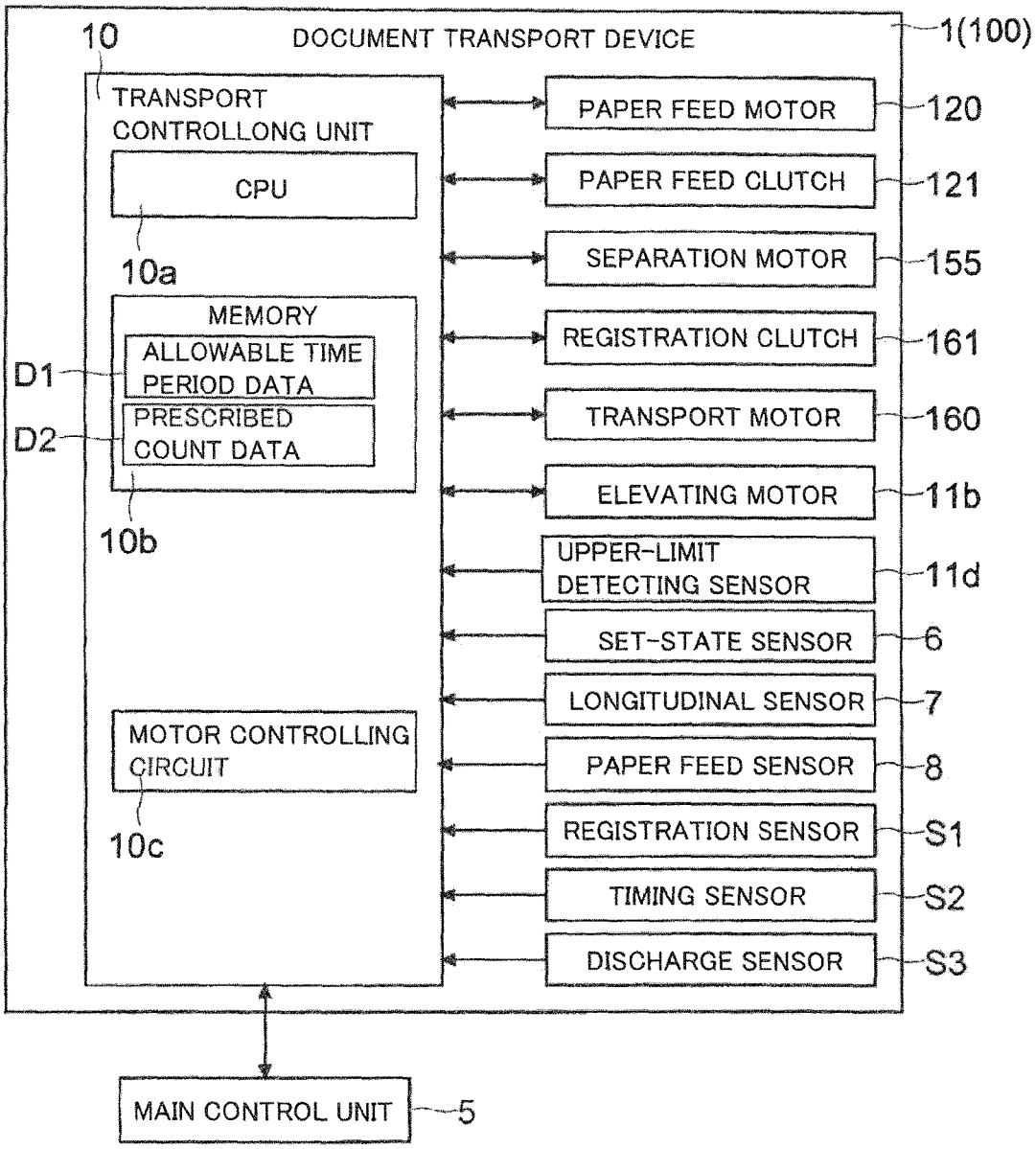
FIG. 4 shows the hardware configuration of the document transport device.

The document transport device 1 as the paper feed device 100 according to the embodiment will now be described with reference to FIGS. 3 and 4. FIG. 4 shows the hardware configuration of the document transport device 1.

As shown in FIG. 4, the document transport device 1 includes a transport controlling unit 10 (corresponding to the "control unit"). The transport controlling unit 10 is connected to the main control unit 5. The transport controlling unit 10 includes a CPU 10*a*, a memory 10*b* (RAM and ROM), and a motor controlling circuit 10*c*. The motor controlling circuit 10*c* is made up of one or more circuits (motor driver ICs) which control rotation and stopping as well as rotational speed of each motor included in the document transport device 1. The transport controlling unit 10 is a substrate including the CPU, RAM, ROM, microcomputer, IC, input/output terminals, and motor controlling circuit.

The document transport device 1 includes the drive sources for transporting documents D and the members for transmitting the drive, such as the paper feed motor 120, the paper feed clutch 121, the separation motor 155, the transport motor 160, and the registration clutch 161. More specifically, in the case of reading a document D set on the document tray 11 for a copying or transmitting job, the main control unit 5 outputs a document transport instruction to the transport controlling unit 10. In response to the instruction from the main control unit 5, the transport controlling unit 10 controls the driving of the paper feed motor 120, the paper feed clutch 121, the separation motor 155, the transport motor 160, and the registration clutch 161 (or, controls the rotations and rotational speeds of the motors as well as ON/OFF of the clutches). In this manner, the transport controlling unit 10 controls the feeding and transporting of a document D which has been set.

The document transport device 1 also includes a set-state sensor 6 and a longitudinal sensor 7 as document presence detecting bodies which can detect whether there is a document D placed (or set) on the document tray 11. The transport controlling unit 10 recognizes whether a document D has been set on the document tray 11 or not, on the basis of the output from the set-state sensor 6. The set-state sensor 6 will be described in detail later.

The document transport device 1 includes the elevating motor 11*b* for moving the elevating portion 11*a* up and down, and an upper-limit detecting sensor 11*d* (see FIG. 3) which detects that the elevating portion 11*a* has been moved up to the upper-limit position. When detecting that one or more sheets of documents D have been set (when recognizing that the output value from the set-state sensor 6 falls within an output value range within which it is determined that one or more sheets of documents D have been set (or, the output value range indicating the presence of document D)), the transport controlling unit 10 rotates the elevating motor 11*b* to cause the uppermost sheet of the set documents D to abut against the pickup roller 14.

The pickup roller 14 is supported by a supporting member (not shown) such that it swings with respect to the rotary shaft (not shown) of the driven roller 154. The pickup roller 14 thus moves up and down. The upper-limit detecting sensor 11*d* is a transmissive photosensor. With the elevation of the elevating portion 11*a*, the pickup roller 14 is lifted via the document D. The transport controlling unit 10 checks the output from the upper-limit detecting sensor 11*d*, and when a projection provided on the supporting member to protrude upward has interrupted the light path of the photosensor of the upper-limit detecting sensor 11*d*, the transport controlling unit 10 detects that the elevating portion 11*a* has been lifted to the upper-limit position, and stops the elevating motor 11*b*.

When detecting that there is no more sheet of document D (when recognizing that the output value from the set-state sensor 6 has changed from a value falling within the output value range indicating the presence of document D to a value falling within an output value range within which it is determined that no document D has been set (or, the output value range indicating the absence of document D)), the transport controlling unit 10 rotates the elevating motor 11*b* in an opposite direction for a certain period of time to cause the elevating portion 11*a* to move down to the lower-limit position.

The longitudinal sensor 7, included in the document transport device 1 as the document presence detecting body, detects whether the document D set on the document tray 11 has a length equal to or longer than a prescribed length. Specifically, in the case where documents D of different sizes are loaded together for reading (or, in the case of a mixed-size document mode), the transport controlling unit 10 detects whether the set documents D include one having a length equal to or longer than the prescribed length, on the basis of the output value from the longitudinal sensor 7. Further, when a user has input, through the operation panel 3, the setting that the size of the document D to be read is the prescribed length or longer, the transport controlling unit 10 checks whether the document D with the prescribed length or longer has actually been set, on the basis of the output value from the longitudinal sensor 7.

More specifically, in preparation for the case where documents D of A4 size and A3 size, or documents D of B5 size and B4 size, are loaded together, the longitudinal sensor 7 is arranged at a distance of not shorter than the shorter side of A4-size paper (about 210 mm) and not longer than the longer side of B4-size paper (about 364 mm) from the end of the document tray 11 (elevating portion 11*a*) on the downstream side in the transport direction. In the document transport device 1 of the present embodiment, the longitudinal sensor 7 is arranged at the position 330 mm away from the end on the downstream side in the transport direction of the document tray 11 (elevating portion 11*a*).

The set-state sensor 6, as the other document presence detecting body, is arranged at the end on the downstream side in the transport direction of the document tray 11. In other words, the set-state sensor 6 is arranged at the position where it can detect even the sheet of paper of the smallest possible size that can be set. More specifically, the set-state sensor 6 is arranged, on the document tray 11 (elevating portion 11*a*), at a distance of up to the length in the transport direction of the smallest possible document D that can be set (minimum-size paper stated in the specification) from the downstream end in the transport direction of the tray. In the document transport device 1 of the present embodiment, regulating guides 11*f* (see FIG. 3) for regulating the document D in the direction perpendicular to the transport direction is provided. This regulating guides 11*f* are slid for positioning (centering) the document D such that the center of the document tray 11 in the direction perpendicular to the transport direction coincides with the center of the document D in the width direction. Therefore, the set-state sensor 6 is arranged within the range covered by a document D of smallest size when the same is positioned in place by the regulating guides 11*f*.

As a result, the set-state sensor 6 is arranged downstream, and the longitudinal sensor 7 is arranged upstream, as compared to each other in the transport direction.

Further, a plurality of sensors are provided along the document transport path, for detecting the transport state of the document. The sensors are transmissive or reflective photosensors, for example. Each sensor outputs different values depending on whether there is a sheet of paper within the detection range or not.

In the multifunctional peripheral 101 (document transport device 1) of the present embodiment, sensors are arranged near the downstream side of the separation transport unit 15 (paper feed sensor 8), near the downstream side of the registration roller pair 16*a* (registration sensor S1), ahead of the upstream side of the reading position (timing sensor S2), and at the discharge roller pair 16*e* (discharge sensor S3).

The paper feed sensor 8 is a sensor for detecting whether a document D has been sent out from the document tray 11 by the paper feed operation of the paper feed unit 12. The transport controlling unit 10 checks whether the output value from the paper feed sensor 8 has changed from a value falling within the output value range indicating the absence of document D to a value falling within the output value range indicating the presence of document D within a predetermined allowable time period from the start of paper feed (start of rotation of the pickup roller 14), to see whether the leading edge of the document D (paper) has reached the position where the paper feed sensor 8 is arranged. The allowable time period is, for example, a time period obtained by dividing the distance from the leading edge position of a set document D (for example, the downstream end of the document tray 11) to the paper feed sensor 8 by the transport speed stated in the specification, and adding allowable advance and delay margins thereto. Allowable time period data D1 indicating this allowable time period is stored in the memory 10*b*.

For the paper feed motor 120 of the present embodiment, a stepping motor is used, and the transport controlling unit 10 supplies a clock signal to the paper feed motor 120. Thus, for example, the minimum number of clocks and the maximum number of clocks for the allowable range from when the rotation is started to when the paper feed sensor 8 detects the leading edge of the document D are stored as the allowable time period data D1.

The transport controlling unit 10 refers to the allowable time period data D1, and when the paper feed sensor 8 cannot detect the arrival of the leading edge of the document D within the allowable time period from the start of paper feed, the transport controlling unit 10 recognizes that the document D is not being fed appropriately. When a document feed failure occurs, the transport controlling unit 10 causes the paper feed unit 12 (pickup roller 14, separation transport unit 15) to perform retry processing. The retry processing refers to processing of causing the paper feed unit 12 to repeat, a prescribed number of times, intermittent paper feed of temporarily stopping the rotations of the pickup roller 14 and the separation transport unit 15 and then resuming the rotations thereof to perform the paper feed operation again, until the paper feed sensor 8 detects the document D (paper). For taking advantage of the motor's large torque during a low speed operation, the rotation of the paper feed motor 120 is stopped and restarted repeatedly to urge the uppermost sheet of document D to be sent out.

The outline of the retry processing will now be described with reference to FIG. 4. In the document transport device 1 of the present embodiment, the intermittent paper feed in the retry processing is repeated a predetermined, prescribed number of times (number of retries) until the document D is fed. The prescribed number of times, which is for example more than one, may be determined as appropriate. In the document transport device 1 (paper feed device 100) of the present embodiment, the prescribed number of times is set to be five. The data indicating the upper limit number of retries is stored as prescribed count data D2 in the memory 10*b* in the document transport device 1. It may be configured such that the prescribed count data D2 can be updated by inputting the setting through the operation panel 3, so that a user can freely set the prescribed number of times.

While the intermittent paper feed is repeated the prescribed number of times, when the paper feed sensor 8 confirms that the document D has been fed, the transport controlling unit 10 continues to feed and transport a next sheet of document D. On the other hand, if the paper feed sensor 8 cannot confirm the feed of document D even after the intermittent paper feed has been repeated the prescribed number of times, the transport controlling unit 10 determines that a non-feed jam has occurred. When determining that a non-feed jam has occurred, the transport controlling unit 10 stops the paper feed and transport operations by the paper feed unit 12 (paper feed motor 120, separation motor 155) and the transport unit 16 (transport motor 160). The transport controlling unit 10 also causes the display unit 31 of the operation panel 3 to notify the user of the occurrence of non-feed jam.

Further, the transport controlling unit 10 checks whether the output value from the paper feed sensor 8 has changed from a value indicating the presence of document D to a value indicating the absence of document D, to see whether the tail end of the document D (paper) has passed over the position where the paper feed sensor 8 is arranged.

The registration sensor S1 is a sensor for detecting whether a document D has arrived at the registration roller pair 16*a*. The transport controlling unit 10 checks the output value from the registration sensor S1 to see whether a document D has arrived at, or passed through, the registration roller pair 16*a*.

The timing sensor S2 is a sensor for detecting whether the paper has reached in front of the transported-document reading contact glass 21. The transport controlling unit 10 checks the output value from the timing sensor S2 to see whether the leading edge of the document D has arrived at the position where the timing sensor S2 is arranged. When the arrival of the leading edge of the document D has been detected by the timing sensor S2, the transport controlling unit 10 notifies to that effect to a reading controlling unit that controls the image reading device 2. On the basis of the notification, the reading controlling unit adjusts the timing to start reading a first page of document D, such that the document D can be read from its leading edge.

The discharge sensor S3 is a sensor for detecting whether the document D has been discharged onto the document discharge tray 17. The transport controlling unit 10 checks the output value from the discharge sensor S3 to see whether the leading edge of the document D has arrived at, and the tail end of the document D has passed over, the position where the discharge sensor S3 is arranged. When the output value from the discharge sensor S3 has changed from a value indicating the presence of document D to a value indicating the absence of document D, the transport controlling unit 10 recognizes that the paper has been discharged onto the document discharge tray 17.

The transport controlling unit 10 recognizes whether a document D has been fed or not, on the basis of the output from the paper feed sensor 8. The transport controlling unit 10 also recognizes a document D arriving at, and passing over, the installation points of the sensors S1 to S3, on the basis of the outputs from the respective sensors. Further, the transport controlling unit 10 recognizes a paper jam of document D in the event that the arrival of the document D could not be detected even after an expected arrival time predetermined for each sensor has passed, and in the event that the passing of the document D could not be detected even after an expected passing time predetermined for each sensor has passed.

<Set-State Sensor 6 and Longitudinal Sensor 7>

Figure 5:
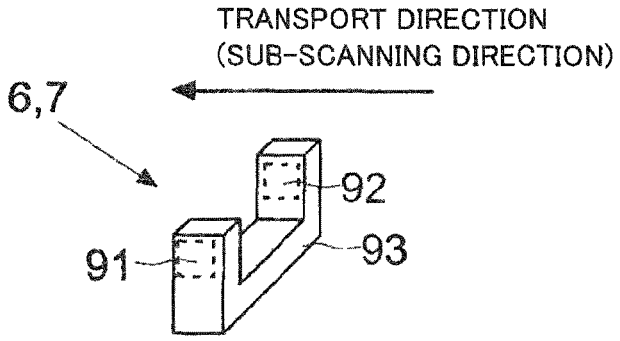
FIG. 5 shows, by way of example, a sensor unit in a set-state sensor or a longitudinal sensor.
Figure 6:
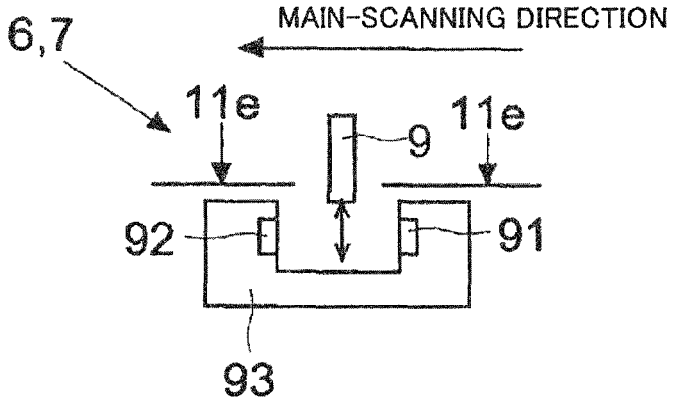
FIG. 6 shows, by way of example, a mechanism of detecting a document using an actuator of the set-state sensor or the longitudinal sensor.
Figure 7:
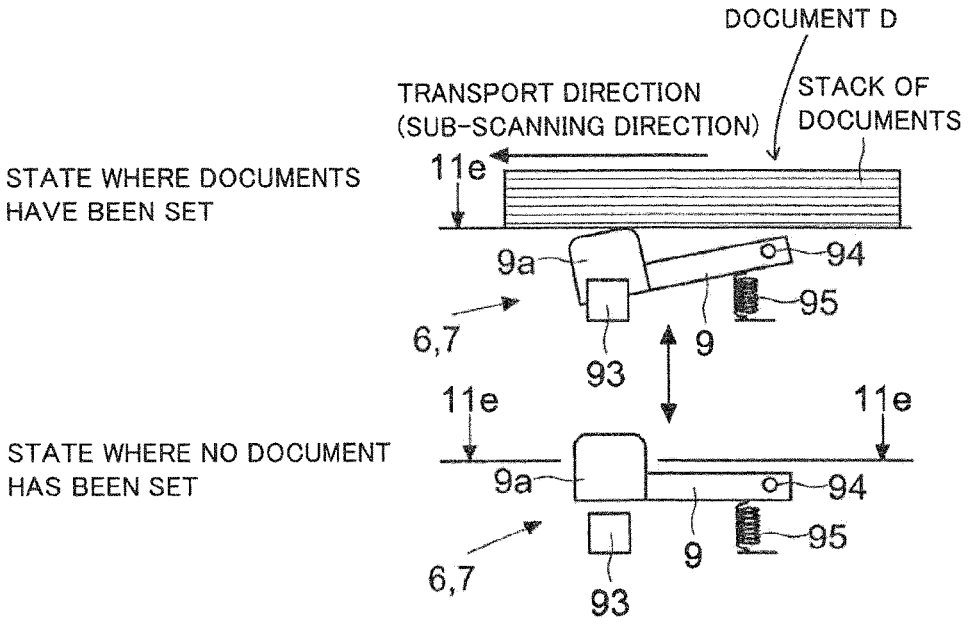
FIG. 7 shows, by way of example, the position and operation of the actuator when documents have been set and when no document has been set.
Figure 8:
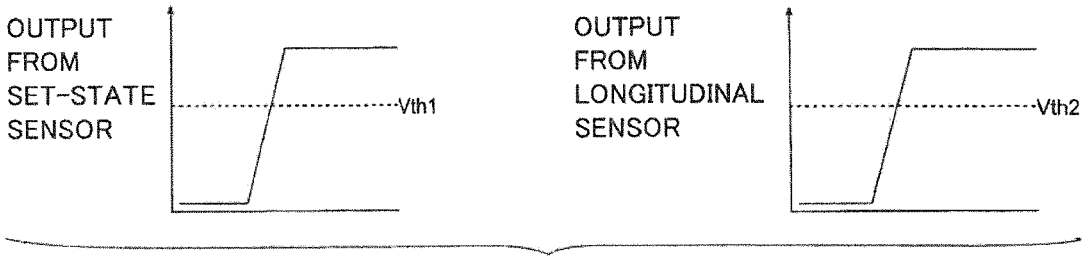
FIG. 8 shows, by way of example, changes of the outputs from the set-state sensor and the longitudinal sensor and detection of the presence or absence of a document.

Examples of the set-state sensor 6 and the longitudinal sensor 7 according to the embodiment will now be described with reference to FIGS. 5 to 8. FIG. 5 shows an example of a sensor unit 93 included in the set-state sensor 6 and the longitudinal sensor 7. FIG. 6 shows, by way of example, a mechanism of detecting a document D using an actuator 9 included in the set-state sensor 6 and the longitudinal sensor 7. FIG. 7 shows, by way of example, the position and operation of the actuator 9 when documents D have been set and when no document D has been set. FIG. 8 shows, by way of example, changes of the outputs from the set-state sensor 6 and the longitudinal sensor 7 and detection of the presence or absence of a document D.

The document transport device 1 includes the set-state sensor 6 and the longitudinal sensor 7 as the document presence detecting bodies that can detect whether a document D has been placed (or, set) on the document tray 11. In the present embodiment, identical sensors can be used for the set-state sensor 6 and the longitudinal sensor 7. Thus, in the following, the case of using identical sensors for the set-state sensor 6 and the longitudinal sensor 7 will be described, with the identical portions of the sensors denoted by the same reference characters.

The set-state sensor 6 and the longitudinal sensor 7 each include a sensor unit 93 which includes a light emitting unit 91 (for example, an LED) and a light receiving unit 92 (for example, a photo transistor). The light emitting unit 91 of the sensor unit 93 emits light toward the light receiving unit 92. The light receiving unit 92 has its sensing surface facing the light emitting unit 91. An output from the light receiving unit 92 changes depending on the magnitude of the received light.

As shown in FIGS. 6 and 7, the set-state sensor 6 and the longitudinal sensor 7 each include an actuator 9. The actuator 9 moves up and down with respect to a supporting point 94. FIG. 6 is an exemplary view of the set-state sensor 6 or the longitudinal sensor 7 as seen from the downstream side in the transport direction. FIG. 7 is an exemplary view of the set-state sensor 6 or the longitudinal sensor 7 as seen from the direction perpendicular to the transport direction.

As shown in FIGS. 6 and 7, in the state where there is no document D, a projecting portion 9*a* of the actuator 9 protrudes upward from a document placement surface 11*e* of the document tray 11. When a stack of documents D is set, it comes into contact with the projecting portion 9*a* of the actuator 9, and presses the actuator 9 downward. The actuator 9, thus moved (pivoted) and lowered in position by the set documents D, interrupts the light path between the light emitting unit 91 and the light receiving unit 92. As a result, the output value from the light receiving unit 92 becomes High or Low.

When there are no more documents D left, the actuator 9 is pressed upward by an urging member 95 (for example, a spring). The actuator 9 returns to a reference position where the projecting portion 9*a* of the actuator 9 protrudes upward from the upper surface (document placement surface 11*e*) of the document tray 11. The actuator 9, thus moved (pivoted) and lifted as the document D was removed, no longer interrupts the light path between the light emitting unit 91 and the light receiving unit 92. As a result, the output value from the light receiving unit 92 becomes High when it was Low in the presence of document(s) D, or becomes Low when it was High in the presence of document(s) D. While the actuator 9 which pivotally moves is used in the present embodiment, an actuator 9 which moves up and down in the direction perpendicular to the document placement surface may be used instead.

The transport controlling unit 10 can determine the presence or absence of a document D set on the document tray 11, by checking the magnitude of the output value from the sensor unit 93 (light receiving unit 92) of the set-state sensor 6 or the longitudinal sensor 7. In other words, the set-state sensor 6 and the longitudinal sensor 7 each include the actuator 9 which moves when it comes into contact with paper that has been set, and each sensor outputs different values depending on the position of the actuator 9.

More specifically, for each of the set-state sensor 6 and the longitudinal sensor 7, a threshold value is set for the output value of the light receiving unit 92, as shown in FIG. 8. In the example shown in FIG. 8, the threshold value for the light receiving unit 92 of the set-state sensor 6 is indicated as a threshold value Vth1, and the threshold value for the light receiving unit 92 of the longitudinal sensor 7 is indicated as a threshold value Vth2. The transport controlling unit 10 compares the analog output value from the set-state sensor 6 with the threshold value Vth1 to determine whether there is a document D set on the document tray 11. For example, in the case where the output of the light receiving unit 92 becomes a low value when the light path is interrupted, the transport controlling unit 10 determines that a document D has been set on the document tray 11 when the output value from the light receiving unit 92 of the set-state sensor 6 falls within the range lower than the threshold value Vth1, whereas it determines that no document D has been set on the document tray 11 when the output value from the light receiving unit 92 of the set-state sensor 6 falls within the range not lower than the threshold value Vth1.

Further, the transport controlling unit 10 compares the output value from the longitudinal sensor 7 with the threshold value Vth2 to determine whether the set document D has a size exceeding a prescribed length. For example, in the case where the output of the light receiving unit 92 becomes Low when the light path is interrupted, the transport controlling unit 10 determines that a document D having a size exceeding the prescribed length has been set when the output value from the light receiving unit 92 of the longitudinal sensor 7 falls within the range lower than the threshold value Vth2, whereas it determines that no document D having a size exceeding the prescribed length has been set when the output value from the light receiving unit 92 of the longitudinal sensor 7 falls within the range not lower than the threshold value Vth2.

<Misdetection by Set-State Sensor 6>

A misdetection made in the detection of the presence or absence of document(s) D using the set-state sensor 6 will now be described with reference to FIG. 7.

In the document transport device 1 (paper feed device 100) of the present embodiment, the transport controlling unit 10 checks the output value from the set-state sensor 6 for detecting the presence or absence of document(s) D set on the document tray 11.

In the state where a document reading job is not being executed, the transport controlling unit 10 checks the output value from the set-state sensor 6 at regular cycles and compares the output value with the threshold value Vth1. In this manner, the transport controlling unit 10 recognizes whether a new document D has been set on the document tray 11.

When an instruction to execute a document reading job is input through the operation panel 3 in the state where one or more sheets of documents D have been set on the document tray 11, the transport controlling unit 10 starts transporting a document D. On the basis of the event that the output from the paper feed sensor 8 has changed from a value falling within the output value range indicating the absence of document D to a value falling within the output value range indicating the presence of document D, the transport controlling unit 10 recognizes that the leading edge of the document D fed has arrived at the installation position of the paper feed sensor 8. Further, on the basis of the event that the output from the paper feed sensor 8 has changed from a value falling within the output value range indicating the presence of document D to a value falling within the output value range indicating the absence of document D, the transport controlling unit 10 recognizes that the tail end of the fed document D has passed over the installation position of the paper feed sensor 8.

In the document transport device 1 of the present embodiment, the transport controlling unit 10 checks the output from the set-state sensor 6, while executing a job, to see whether there is any document D left on the document tray 11 at a predetermined check time. The predetermined check time is specifically a time point at which the transport controlling unit 10 has recognized that the tail end of the document D has passed over the paper feed sensor 8, on the basis of the output from the paper feed sensor 8.

More specifically, in the case where the output value from the set-state sensor 6 at the check time falls within the output value range indicating the absence of document D, the transport controlling unit 10 recognizes that the page fed immediately before is the last one of the sheets of documents D (or, recognizes that no more documents D are left on the document tray 11), and that all the documents D have been fed in the reading job. In this case, the transport controlling unit 10 refrains from causing the paper feed unit 12 and the paper feed motor 120 to start feeding a next sheet of document D.

On the other hand, in the case where the output value from the set-state sensor 6 at the check time falls within the output value range indicating the presence of document, the transport controlling unit 10 recognizes that the page fed immediately before is not the last one of the sheets of documents D set on the document tray 11, and that there is at least a sheet of document D left on the document tray 11. When there is any remaining document D, the transport controlling unit 10 causes the paper feed unit 12 and the paper feed motor 120 to start feeding a next sheet of document D.

Here, as explained previously, the set-state sensor 6 of the present application includes the actuator 9, and the set-state sensor 6 outputs different values depending on the rotational angle (position) of the actuator 9. When the documents D placed have all been fed, the actuator 9 returns from the state where it is pressed down by the set document D (position when the document D is set), back to the position (reference position) when no document D is set. The urging member 95 is provided so as to cause the actuator 9 to quickly return to the reference position when there is no document D left on the document tray 11.

The time taken by the actuator 9 to return to the reference position, however, may become longer, because of, for example, degradation of the urging force of the urging member 95 over time. If it takes longer for the actuator 9 to return to the reference position, the actuator 9 may not have fully returned to the reference position at the check time of the presence or absence of document(s) D. This may cause an undesirable situation where, even though no more documents D remain, the output value from the set-state sensor 6 does not change to a value falling within the output value range indicating the absence of document D. In such a case, the transport controlling unit 10 makes a misdetection (misrecognition) that there still remains a document D on the document tray 11 even though there is actually no document D set on the document tray 11. Conventionally, intermittent paper feed would be repeated in the retry processing and, with actually no document D placed on the tray, it was erroneously detected that the non-feed jam occurred.

In view of the foregoing, in the document transport device 1 (paper feed device 100) of the present embodiment, paper feed control is carried out in which the retry processing after the last sheet of document D was fed is improved, thereby preventing wasteful retry processing (wasteful repetition of intermittent paper feed) based on a misdetection of the presence or absence of paper (document), and also avoiding a misdetection of a non-feed jam.

<Paper Feed Control>

Figure 9:
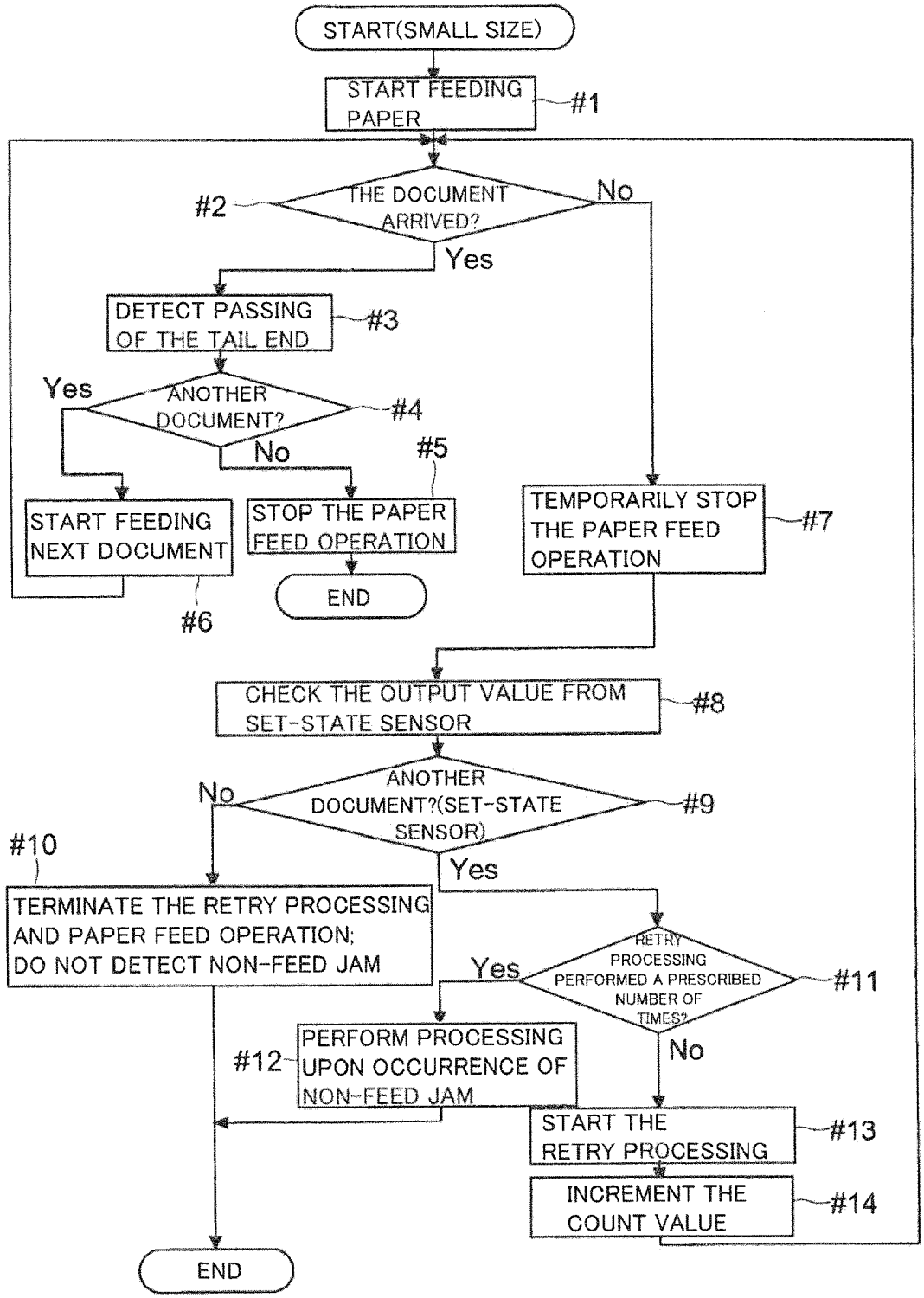
FIG. 9 is a flowchart illustrating an exemplary flow of paper feed control when the set document has a length (in the transport direction) shorter than a prescribed length (i.e. when the document size is small)
Figure 10:
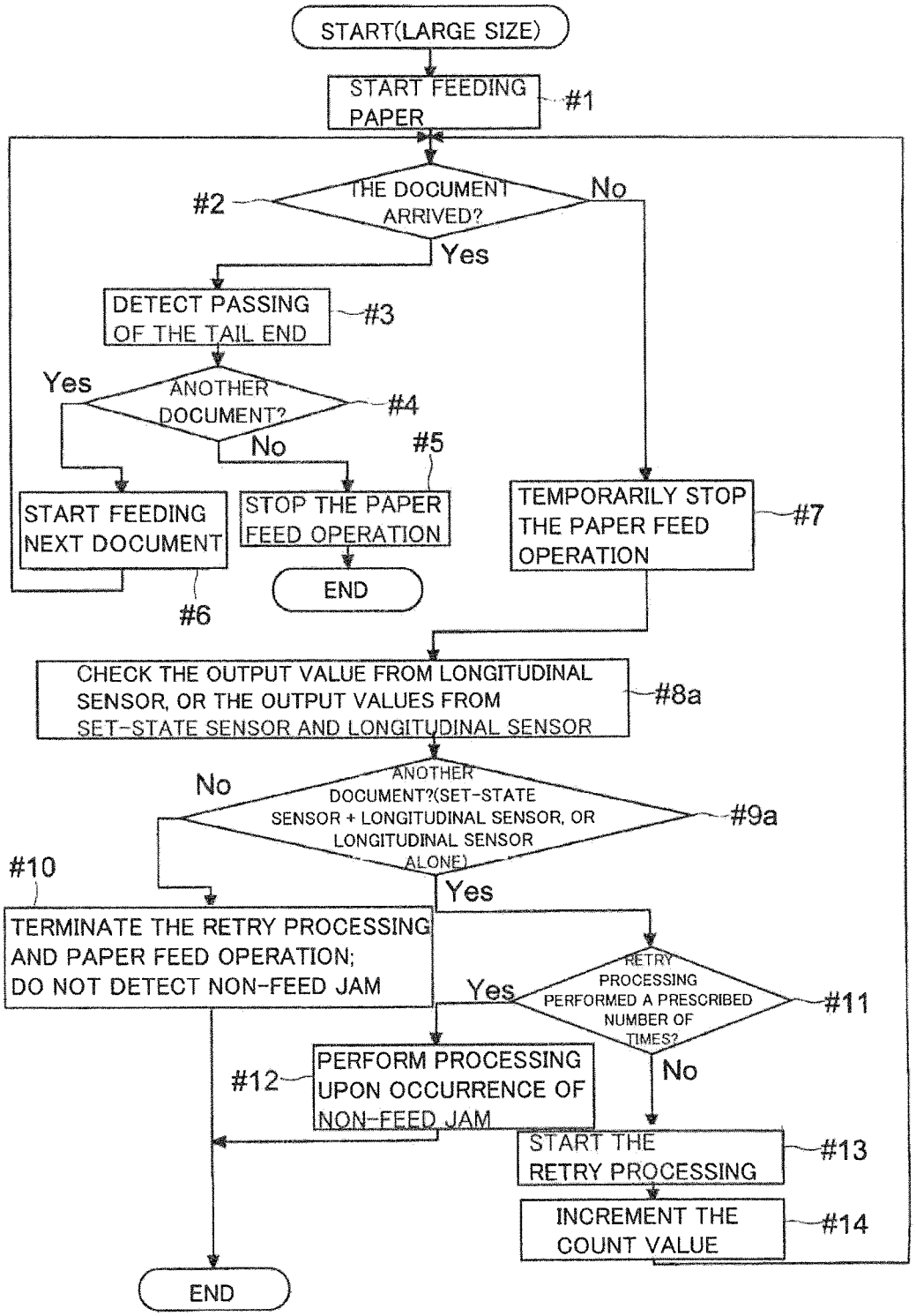
FIG. 10 is a flowchart illustrating an exemplary flow of paper feed control when the set document has a length (in the transport direction) not shorter than the prescribed length (i.e. when the document size is large).

An exemplary flow of the paper feed control performed by the document transport device 1 according to the embodiment will now be described with reference to FIGS. 9 and 10. FIG. 9 is a flowchart illustrating an exemplary flow of the paper feed control in the case where the length (in the transport direction) of document(s) D set on the document tray 11 is shorter than a prescribed length (i.e. the document size is small). FIG. 10 is a flowchart illustrating an exemplary flow of the paper feed control in the case where the length (in the transport direction) of the set document(s) D is not shorter than the prescribed length (i.e. the document size is large).

<1. In the Case of Documents Shorter than a Prescribed Length>

First, the paper feed control of documents D in the case where each document D that has been set has a length in the transport direction shorter than a prescribed length (so the presence or absence of the document D cannot be detected by the longitudinal sensor 7) will be described.

As explained previously, the transport controlling unit 10 can detect whether the document D that has been set is shorter than the prescribed length or not, by checking the output from the longitudinal sensor 7. Specifically, when the presence of a document D has been detected on the basis of the output from the set-state sensor 6 and when the presence of the document D has not been detected on the basis of the output value from the longitudinal sensor 7, then the transport controlling unit 10 determines that the length of the set document D is shorter than the prescribed length. On the other hand, when the presence of a document D has been detected on the basis of the output from the set-state sensor 6 and when the presence of the document D has also been detected on the basis of the output from the longitudinal sensor 7, then the transport controlling unit 10 determines that the length of the set document D is not shorter than the prescribed length.

The operation panel 3 accepts the size setting for a set document D. Thus, it may be configured such that the transport controlling unit 10 recognizes whether the set document D is of a prescribed length or longer, on the basis of the document size set by the user.

The flow in FIG. 9 starts at the time point when, for reading document(s) D shorter than the prescribed length, the transport controlling unit 10 starts rotating the paper feed motor 120 to cause the paper feed unit 12 (pickup roller 14, separation transport unit 15) to start feeding the document D. At this time point, the transport controlling unit 10 has recognized that the output value from the set-state sensor 6 falls within the output value range indicating the presence of set document(s) D and thus detected that at least one sheet of document D has been set.

First, the transport controlling unit 10 starts rotating the paper feed motor 120 to start feeding paper (step #1). The transport controlling unit 10 then checks whether the paper feed sensor 8 was able to detect the arrival of the leading edge of the document D within the time period determined in the allowable time period data D1 (or, within a prescribed number of clocks) from the start of the paper feed of the document D (step #2).

If the arrival of the leading edge was able to be detected (meaning that the document D has been sent out from the document tray 11 appropriately; Yes in step #2), the transport controlling unit 10 causes the transport unit 16 to continue to transport the document D, and detects on the basis of the output from the paper feed sensor 8 that the tail end of the document D has passed over the paper feed sensor 8 (step #3).

The transport controlling unit 10 then checks whether there is any document D left (or, remaining) on the document tray 11, on the basis of the output from the set-state sensor 6 (step #4). If there remains no document D (No in step #4), the transport controlling unit 10 stops the paper feed operation by the paper feed unit 12 (paper feed motor 120, separation motor 155) (step #5). It is noted that the transport controlling unit 10 stops the transport operation by the transport unit 16 (transport motor 160) when it is detected on the basis of the output from the discharge sensor S3 that the last one of the set documents was discharged. Then, the flow is terminated (END).

On the other hand, if the transport controlling unit 10 detects that there still remains a document D on the document tray 11 (Yes in step #4), the transport controlling unit 10 starts feeding a next sheet of document D (step #6). It should be noted that the transport controlling unit 10 provides a certain interval between sheets being fed, for example by stopping the pickup roller 14, after the arrival of a document D is detected by the paper feed sensor 8, about the time when the document D being fed has passed the downstream end of the document tray 11. The transport controlling unit 10 keeps the paper feed unit 12 (pickup roller 14) in the stopped state until at least the tail end of the preceding document D passes over the paper feed sensor 8.

After securing the prescribed interval between the sheets of documents D, the transport controlling unit 10 resumes the rotation of the pickup roller 14 and the paper feed unit 12 to start feeding the next sheet of document D (step #6). The flow then returns to step #2.

If the paper feed sensor 8 cannot detect the arrival of the leading edge of the document D within the allowable time period from the start of the paper feed (No in step #2), the transport controlling unit 10 temporarily stops the paper feed operation (rotational operation) of the paper feed unit 12 (pickup roller 14) by controlling the paper feed clutch 121, for example, for retry processing or for determination of non-feed jam (step #7). The transport controlling unit 10 then checks the output value from the set-state sensor 6 (step #8) before starting the intermittent paper feed (before starting the retry processing). The transport controlling unit 10 determines whether there is any document on the document tray 11 (step #9). Specifically, the transport controlling unit 10 checks whether the output value from the set-state sensor 6 falls within the output value range within which it is determined that there is no document D (the output value range indicating the absence of document D).

If the output from the set-state sensor 6 is a value falling within the output value range indicating the absence of document D (i.e. when the actuator 9 has returned to the position in the absence of document D after a single document D or the last one of documents D was fed; No in step #9), the transport controlling unit 10 determines that there is no paper on the paper tray (document tray 11) and that it is not the non-feed jam. The transport controlling unit 10 refrains from causing the paper feed unit 12 to perform the retry processing (paper feed operation) (or, it refrains from restarting the paper feed motor 120), and it does not detect the non-feed jam (step #10). No further paper feed is unnecessary, so the flow is terminated (END). It should be noted that, after the start of a job, when it has been determined at the first sheet of document D that there is no document D placed on the document tray 11 on the basis of the output value from the set-state sensor 6, before performing the retry processing, the transport controlling unit 10 may cause the display unit 31 in the operation panel 3 to display a notification prompting a user to set a document D again.

On the other hand, if the output from the set-state sensor 6 indicates that there still remains (there is) a document D on the document tray 11 (Yes in step #9), the transport controlling unit 10 checks whether the intermittent paper feed has been already repeated the prescribed number of times for the sheet of document D about to be fed (step #11).

If the intermittent paper feed has already been repeated the prescribed number of times (Yes in step #11), the transport controlling unit 10 performs the processing upon occurrence of non-feed jam (step #12). As the processing upon occurrence of non-feed jam, the transport controlling unit 10 performs processing for stopping the paper feed operation by the paper feed unit 12, stopping the document transport operation by the transport unit 16, and notifying the user of the occurrence of the non-feed jam via the display unit 31 of the operation panel 3.

On the other hand, if the intermittent paper feed has not been repeated the prescribed number of times (No in step #11), the transport controlling unit 10 rotates the paper feed unit 12 (pickup roller 14, paper feed motor 120, separation transport unit 15) again to do the intermittent paper feed (retry processing) (step #13). The transport controlling unit 10 increments the count value of the number of times of retries performed so far, by "1" (step #14). The flow then returns to step #2.

After the flow returns to step #2, if the paper feed sensor 8 cannot detect the arrival of a document, the output value from the set-state sensor 6 is checked before the next intermittent paper feed is performed (steps #8, #9). In this manner, each time before the start of the intermittent paper feed, the transport controlling unit 10 checks the output value from the set-state sensor 6.

<2. In the Case of Documents of the Prescribed Length or Longer Only>

Next, the paper feed control of documents D in the case where every document D that has been set has a length in the transport direction equal to or longer than the prescribed length (so the presence or absence of the document D can be detected by the longitudinal sensor 7) will be described with reference to FIG. 10.

As explained previously, the transport controlling unit 10 can detect whether the set document D is shorter than the prescribed length or not, by checking the output from the longitudinal sensor 7. The transport controlling unit 10 specifies the size of the set document D on the basis of a combination of the position of the regulating guide 11*f* slid in accordance with the paper size and the output from the longitudinal sensor 7. For example, while the regulating guide 11*f* is set at the same position for a document of A4 size and a document of A3 size, the longitudinal sensor 7 outputs different values for the A4-size document and the A3-size document. It is noted that the regulating guide 11*f* is provided with a guide position detecting sensor (not shown) for detecting the position of the regulating guide 11*f*. The guide position detecting sensor is, for example, a sensor which includes a variable resistance having its resistance value varying depending on the slid position. The transport controlling unit 10 receives the output from the guide position detecting sensor and recognizes the document size in the main scanning direction. The operation panel 3 accepts size setting for the set documents. Thus, the transport controlling unit 10 may be configured to recognize whether the set documents D include only those of the prescribed length or longer, on the basis of the document size set by the user.

In the case of reading only the documents D having the length in the transport direction equal to or longer than the prescribed length, the transport controlling unit 10 can check, not only the output value from the set-state sensor 6, but also the output value from the longitudinal sensor 7 to see whether there still remains a document D on the document tray 11. Thus, in the following, an exemplary flow of the paper feed control in the case where the document size is the prescribed length or longer and where the transport controlling unit 10 checks the output value from the longitudinal sensor 7 will be described with reference to FIG. 10.

The flow in FIG. 10 starts at the time point when, for reading documents D of the prescribed length or longer, the transport controlling unit 10 starts rotating the paper feed motor 120 to cause the paper feed unit 12 (pickup roller 14, paper feed belt 151) to start feeding a sheet of document D.

Here, in the case of reading the documents D of the prescribed length or longer as well, as shown in FIG. 10, steps #1 to #7 are identical to those in FIG. 9, and the description thereof can be referred to here. Therefore, the description of steps #1 to #7 in FIG. 10 will be omitted.

If the paper feed sensor 8 cannot detect the arrival of the leading edge of the document D within the allowable time period from the start of the paper feed (No in step #2), the transport controlling unit 10 temporarily stops the paper feed unit 12 (pickup roller 14) (step #7) and, before starting the intermittent paper feed (before starting the retry processing), the transport controlling unit 10 checks the output value from the longitudinal sensor 7 alone, or the output values from the set-state sensor 6 and the longitudinal sensor 7 (step #8*a*).

In the case of reading documents D of the prescribed length or longer, the sensor actually used for checking whether there still remains a document D on the document tray 11 or not may be the longitudinal sensor 7 alone. Alternatively, the longitudinal sensor 7 and the set-state sensor 6 may both be used.

In the case of using only the longitudinal sensor 7, the transport controlling unit 10 checks whether the output from the longitudinal sensor 7 falls within the output value range within which it is determined that no document D of the prescribed length or longer has been set (the output value range indicating the absence of document D) (step #9*a*). In other words, in the case of reading documents D of the prescribed length or longer, the transport controlling unit 10 may check whether there still remains a document D on the document tray 11, not on the basis of the output value from the set-state sensor 6, but on the basis of the output value from the longitudinal sensor 7 alone. By doing so, even if the actuator 9 of the set-state sensor 6 takes a considerably long time before returning to the position in the absence of set document D, it is possible to accurately detect that there is no document D remaining on the document tray 11.

In the case of using both of the set-state sensor 6 and the longitudinal sensor 7, the transport controlling unit 10 checks whether one of the following conditions has been satisfied: that the output from the set-state sensor 6 falls within the output value range within which it is determined that no document D has been set (the output value range indicating the absence of document D), and that the output from the longitudinal sensor 7 falls within the output value range within which it is determined that no document D with the prescribed length or longer has been set (the output value range indicating the absence of document D) (step #9*a*). If one of the conditions has been satisfied, it means that no document D has been set, or that a document D has been set but in an inappropriate manner. In either case, it is not the state where a document D can be sent out, so the retry processing and the detection of non-feed jam are both useless. Thus, if one of those conditions has been satisfied (No in step #9*a*), the transport controlling unit 10 determines that there is no document D on the paper tray (document tray 11) and that it is not the non-feed jam. The transport controlling unit 10 thus refrains from doing any more intermittent paper feed (retry processing), and does not detect the non-feed jam (step #10).

In the case of reading the documents D of the prescribed length or longer as well, as shown in FIG. 10, steps #10 to #14 are identical to those in FIG. 9, and the description thereof can be referred to here. Therefore, the description of steps #10 to #14 in FIG. 10 will also be omitted.

In the case of reading the documents D of the prescribed length or longer as well, similarly as in the processing described in conjunction with FIG. 9, each time before the start of the intermittent paper feed, the transport controlling unit 10 may check, not the output from the longitudinal sensor 7, but the output value from the set-state sensor 6 alone, to see whether the output value from the set-state sensor 6 falls within the output value range within which it is determined that there is no document D (the output value range indicating the absence of document D) for each retry, and when it is determined that there is no paper on the paper tray (document tray 11) and that it is not the non-feed jam, the transport controlling unit 10 may terminate the intermittent paper feed (retry processing) and the paper feed operation of the paper feed unit 12.

<3. In the Case of Mixed-Size Document Mode>

The paper feed control in the case of a mixed-size document mode where documents D of different sizes are loaded together will now be described.

In the document transport device 1 and the image reading device 2 of the present application, a stack of documents D of mixed sizes can be set on the document tray 11 for reading the documents D. The operation panel 3 accepts the setting for reading documents D in the mixed-size document mode. For example, a stack of documents D containing A4-size and A3-size documents D may be set on the document tray 11 for reading.

In the case of reading documents D when the mixed-size document mode has been set, the transport controlling unit 10 transports the documents D, one by one, to the reading position (to the transported-document reading contact glass). Then, the image reading device 2 reads the documents D with the maximum reading size, for example. The processing circuit included in the image reading device 2 or the image processing unit 52 performs image processing on the image data obtained by reading the documents D to determine the size of each image data, removes any extra pixels (image regions) relative to the determined size, and generates the image data of the determined size.

In the mixed-size document mode, documents D of different sizes are set. Thus, even if the output value from the longitudinal sensor 7 has changed to a value falling within the output value range indicating the absence of document D, a document D with the length shorter than the prescribed length may still remain on the document tray 11. As such, in the mixed-size document mode, the longitudinal sensor 7 may not be able to accurately detect whether there is a document D remaining on the document tray 11.

Thus, in the mixed-size document mode, before starting the intermittent paper feed (retry processing), the transport controlling unit 10 checks whether there is a document D remaining on the document tray 11 by using the set-state sensor 6 alone, without the use of the longitudinal sensor 7, as shown in FIG. 9.

As described above, the paper feed device 100 (document transport device 1) according to the embodiment includes: the paper tray (document tray 11) on which one or more sheets of paper are set; the set-state sensor 6 which includes the actuator 9 configured to move when paper is set, the set-state sensor being arranged at a position where any paper set on the tray can be detected and outputting different values depending on the position of the actuator 9; the paper feed unit 12 configured to rotate the feeding rotary body (pickup roller 14) to feed the paper set on the paper tray; the transport unit 16 configured to transport the paper fed from the paper feed unit 12; the paper feed sensor 8 configured to detect that the paper has been sent out of the paper tray by the paper feed operation of the paper feed unit 12; and the control unit (transport controlling unit 10) configured to detect the presence or absence of paper on the paper tray on the basis of the magnitude of the output value from the set-state sensor 6, detect whether the paper has been fed by the paper feed operation, on the basis of the output from the paper feed sensor 8, check the output value from the set-state sensor 6 when the paper feed sensor 8 has detected passing of a tail end of the paper, and cause the paper feed unit 12 to perform a paper feed operation for a next sheet of paper when it is determined that there is the paper. When the control unit detects on the basis of the output from the paper feed sensor 8 that no paper has been fed, the control unit causes the paper feed unit 12 to perform retry processing of repeating intermittent paper feed of stopping and then resuming the paper feed operation a prescribed number of times until the paper feed sensor 8 detects paper. The control unit checks an output from the set-state sensor 6 each time before the start of the intermittent paper feed. In the case where no paper feed is detected even after the intermittent paper feed was performed the prescribed number of times, the control unit determines that a non-feed jam has occurred. In the case where it is detected that there is no paper on the paper tray before the number of times of the intermittent paper feed reaches the prescribed number of times, the control unit causes the paper feed unit 12 to terminate the retry processing (and terminate even the paper feed processing itself) and determines that there is no paper on the paper tray and it is not the non-feed jam.

Conventionally, the determination as to whether there is no more paper on the paper tray (document tray 11) and whether to continue the paper feed operation or not was made only once at a certain time point, and a misdetection at the certain time point would lead to wasteful repetition of the intermittent paper feed in the retry processing and a misdetection of the non-feed jam. In contrast, in the present disclosure, even in the case where it takes time for the actuator 9 to return to the position (reference position) in the absence of paper, once the actuator 9 has returned to the reference position during the repetition of the intermittent paper feed, the retry processing is terminated and the non-feed jam is no longer detected. In other words, each time the intermittent paper feed is performed, immediately before the paper feed is started, it is checked whether there is no more paper or not. This increases the number of times of checking whether a sheet of paper is set on the paper tray.

Accordingly, at the time point of determining whether to perform a paper feed operation for a next sheet or not, even if a misdetection is made that there still remains a sheet on the paper tray (document tray 11) because of the slow movement of the actuator 9, the rechecking during the retry processing (during the repetition of the intermittent paper feed) can correct the misdetection. This can suppress wasteful repetition of the intermittent paper feed and can reduce the misdetection of non-feed jam. The wasteful retry processing as well as the misdetection of non-feed jam can be prevented without the need to newly provide a special sensor. This can suppress the manufacturing cost of the paper feed device 100 (document transport device 1).

The paper feed device 100 (document transport device 1) according to the embodiment may include the longitudinal sensor 7 arranged upstream of the set-state sensor 6, and the control unit (transport controlling unit 10) may detect whether the paper that has been set has a prescribed length or longer, on the basis of an output from the longitudinal sensor 7. In the case where only sheets of paper with the prescribed length or longer have been set, the control unit may check an output value, not from the set-state sensor, but from the longitudinal sensor each time before the start of the intermittent paper feed and, if it is detected that no paper with the prescribed length or longer has been set, the control unit may cause the paper feed unit 12 to terminate the retry processing (repetition of the intermittent paper feed). As a result, even if there is a misdetection about the presence or absence of paper, the control unit determines that there is no paper on the paper tray and that it is not the non-feed jam, and thus, it does not detect the occurrence of the non-feed jam.

In this manner, when only large sheets of paper have been set, the longitudinal sensor 7 alone can be used to check whether there is no more paper on the paper tray (document tray 11) or not, to reduce the wasteful retry processing as well as a misdetection of the non-feed jam. Generally, as compared to the actuator 9 in the set-state sensor 6 that moves every time a sheet of paper is set, the actuator 9 in the longitudinal sensor 7 suffers less damage and less fatigue. Thus, as compared to the case of using the set-state sensor 6 alone, using the longitudinal sensor 7 alone may enable more accurate rechecking about the presence or absence of paper on the paper tray.

The paper feed device 100 (document transport device 1) according to the embodiment may include the longitudinal sensor 7 arranged upstream of the set-state sensor 6, and the control unit (transport controlling unit 10) may detect whether the paper that has been set has a prescribed length or longer, on the basis of an output from the longitudinal sensor 7. In the case where paper with the prescribed length or longer has been set, the control unit may check output values of the set-state sensor 6 and the longitudinal sensor 7 each time before the start of the intermittent paper feed and, in the case where one of a condition that it is detected on the basis of the output value from the set-state sensor 6 that there is no paper on the paper tray (document tray 11) and a condition that it is detected on the basis of the output value from the longitudinal sensor 7 that no paper with the prescribed length or longer has been set is satisfied, the control unit may cause the paper feed unit 12 to terminate the retry processing. As a result, even if there is a misdetection about the presence or absence of paper, the control unit determines that there is no paper on the paper tray and that it is not the non-feed jam, and thus, it does not detect the occurrence of the non-feed jam.

In this manner, when only large sheets of paper have been set, once it can be detected on the basis of the output value of one of the set-state sensor 6 and the longitudinal sensor 7 that there is no paper set on the tray, the retry processing (intermittent paper feed) can be terminated and the misdetection of non-feed jam can be suppressed. It is thus possible to accurately check the absence of paper on the paper tray by using the plurality of sensors.

The control unit (transport controlling unit 10) may detect whether only sheets of paper (documents) having the length shorter than the prescribed length have been set, on the basis of the output from the longitudinal sensor 7. In the case where only sheets of paper having the length shorter than the prescribed length have been set, the control unit (transport controlling unit 10) may check an output value, not from the longitudinal sensor 7, but from the set-state sensor 6 each time before the start of the intermittent paper feed and, in the case where it is detected on the basis of the output value from the set-state sensor 6 that there is no paper on the paper tray (document tray 11), the control unit may cause the paper feed unit 12 to terminate the retry processing. As a result, even if there is a misdetection about the presence or absence of paper, the control unit determines that there is no paper on the paper tray and that it is not the non-feed jam, and thus, it does not detect the occurrence of the non-feed jam. In the case where sheets of paper that have been set are too short in length to contact the actuator 9 of the longitudinal sensor 7, the presence or absence of paper on the paper tray cannot be detected using the longitudinal sensor 7. The sensor for use in rechecking whether there is no more paper set or not is determined in accordance with the size of the set paper, as explained above, enabling accurate checking about the presence or absence of paper on the paper tray.

The paper feed device 100 (document transport device 1) according to the embodiment may further include the operation unit (operation panel 3) configured to accept setting for a mixed-size document mode in which sheets of paper of different sizes are loaded together on the paper tray (document tray 11). In the case where setting of performing reading in the mixed-size document mode has been accepted in the operation unit, the control unit (transport controlling unit 10) may check an output value, not from the longitudinal sensor 7, but from the set-state sensor 6 each time before the start of the intermittent paper feed and, if it is determined on the basis of the output value from the set-state sensor 6 that there is no paper on the paper tray, the control unit may cause the paper feed unit 12 to terminate the retry processing. As a result, even if there is a misdetection about the presence or absence of paper, the control unit determines that there is no paper on the paper tray and that it is not the non-feed jam, and thus, it does not detect the occurrence of the non-feed jam.

In the mixed-size document mode, the sheets of paper set on the paper tray (document tray 11) vary in size, so the longitudinal sensor 7 may not be able to detect all the sheets. Even in the mixed-size document mode, the control unit can accurately recheck the presence or absence of paper on the paper tray (document tray 11) while repeating the intermittent paper feed, without relying on the longitudinal sensor 7.

The paper feed device 100 according to the embodiment can be included in the document transport device 1 or in the image forming apparatus (multifunctional peripheral 101). The paper feed device 100 according to the embodiment does not perform wasteful retry processing, or detect a non-feed jam, on the basis of a misdetection that there still remains a sheet of paper even though no sheet is left on the tray. Accordingly, it is possible to provide the document transport device 1 and the image forming apparatus (multifunctional peripheral 101) which are easy to use for users.

While the embodiment of the present disclosure has been described above, the scope of the present disclosure is not limited thereto; various modifications are possible in the implementation of the disclosure without departing from the gist thereof.

The present disclosure is applicable to the paper feed device which uses a motor to feed a sheet of paper.

What is claimed is:

1. A paper feed device comprising:

a paper tray on which one or more sheets of paper are set;

a set-state sensor including an actuator which rotates a predetermined rotational angle and returns to a reference position by an urging force of an urging member when no document is set and arranged at a position where any set paper can be detected, the actuator being configured to move when paper is set, the set-state sensor outputting different values depending on the position of the actuator;

a paper feed unit configured to feed the paper set on the paper tray by rotating a feeding rotary body;

a transport unit configured to transport the paper fed from the paper feed unit;

a paper feed sensor configured to detect that the paper has been sent out of the paper tray by the paper feed operation of the paper feed unit; and a control unit configured to detect the presence or absence of paper on the paper tray on the basis of the magnitude of an output value from the set-state sensor, detect whether the paper has been fed by the paper feed operation on the basis of an output from the paper feed sensor, check the output value from the set-state sensor when the paper feed sensor has detected passing of a tail end of the paper, and cause the paper feed unit to perform the paper feed operation for a next page when determining that there is the paper, wherein when the control unit detects on the basis of the output from the paper feed sensor that no paper has been fed, the control unit causes the paper feed unit to perform retry processing of repeating intermittent paper feed of stopping and then resuming the paper feed operation a prescribed number of times until the paper feed sensor detects paper, the control unit checks an output from the set-state sensor each time before the start of the intermittent paper feed and, in the case where no paper feed is detected even after the intermittent paper feed was performed the prescribed number of times, the control unit determines that a non-feed jam has occurred, and in the case where it is detected that there is no paper on the paper tray before the number of repetition of the intermittent paper feed reaches the prescribed number of times, the control unit causes the paper feed unit to terminate the retry processing and determines that, with no paper on the paper tray, it is not the non-feed jam.

2. The paper feed device according to claim 1, further comprising a longitudinal sensor arranged upstream of the set-state sensor, wherein the control unit detects whether the paper set has a prescribed length or longer, on the basis of an output from the longitudinal sensor, and in the case where one or more sheets of paper set on the tray all have the prescribed length or longer, the control unit checks an output value, not from the set-state sensor, but from the longitudinal sensor each time before the start of the intermittent paper feed, and in the case where it is detected that no paper with the prescribed length or longer has been set, the control unit causes the paper feed unit to terminate the retry processing.

3. The paper feed device according to claim 1, further comprising a longitudinal sensor arranged upstream of the set-state sensor, wherein the control unit detects whether the paper set has a prescribed length or longer, on the basis of an output from the longitudinal sensor, and in the case where one or more sheets of paper set on the tray include the sheet(s) having the prescribed length or longer, the control unit checks output values from the set-state sensor and the longitudinal sensor each time before the start of the intermittent paper feed, and in the case where one of a condition that it is detected on the basis of the output value from the set-state sensor that there is no paper on the paper tray and a condition that it is detected on the basis of the output value from the longitudinal sensor that no paper with the prescribed length or longer has been set is satisfied, the control unit causes the paper feed unit to terminate the retry processing.

4. The paper feed device according to claim 2, wherein in the case where one or more sheets of paper set on the tray are all shorter than the prescribed length, the control unit checks an output value, not from the longitudinal sensor, but from the set-state sensor each time before the start of the intermittent paper feed, and in the case where it is detected that there is no paper on the paper tray, the control unit causes the paper feed unit to terminate the retry processing.

5. The paper feed device according to claim 1, further comprising:

a longitudinal sensor arranged upstream of the set-state sensor; and an operation unit configured to accept setting for a mixed-size document mode in which sheets of paper of different sizes are loaded together on the paper tray; wherein in the case where setting of performing reading in the mixed-size document mode has been accepted in the operation unit, the control unit checks an output value, not from the longitudinal sensor, but from the set-state sensor each time before the start of the intermittent paper feed, and in the case where it is determined on the basis of the output value from the set-state sensor that there is no paper on the paper tray, the control unit causes the paper feed unit to terminate the retry processing.

6. A document transport device comprising the paper feed device according to claim 1.

7. An image forming apparatus comprising the paper feed device according to claim 1.

8. The paper feed device according to claim 1, wherein the set-state sensor is arranged at the paper tray.

* * * * *